United States Patent [19]

Tweedy

[11] 4,279,537

[45] Jul. 21, 1981

[54] APPARATUS FOR AERATING AND MAINTAINING AN ICE FREE SURFACE AREA ON A BODY OF WATER

[76] Inventor: William H. Tweedy, P.O. Box 68, Glasford, Ill. 61533

[21] Appl. No.: 151,922

[22] Filed: May 21, 1980

[51] Int. Cl.[3] ..... E02B 15/02

[52] U.S. Cl. ..... 405/61

[58] Field of Search ..... 405/60, 61; 210/195.1, 210/136

[56] References Cited

U.S. PATENT DOCUMENTS

| | | | |
|---|---|---|---|
| 3,129,565 | 4/1964 | Bellamy | 405/61 |
| 3,193,260 | 7/1965 | Lamb | 405/61 |
| 3,293,861 | 12/1966 | Hinde | 405/61 |
| 3,318,098 | 5/1967 | Heddinett et al. | 405/61 |

FOREIGN PATENT DOCUMENTS

| | | | |
|---|---|---|---|
| 746669 | 11/1966 | Canada | 405/61 |

*Primary Examiner*—Theodore A. Granger

*Attorney, Agent, or Firm*—McCaleb, Lucas & Brugman

[57] ABSTRACT

The apparatus comprises an air diffusion or dispersion unit mounted on a weighted concrete base submerged at the bottom of a body of water. The unit has a vertical pipe upstanding from the concrete base. An air line extends from an air compressor on shore into the bottom of the vertical pipe where it collects air and releases it periodically from the top of the pipe in a series of relatively large volume, intermittent, discharges into the water. A check valve is located in the air line or diffusion unit to prevent back flow of water to below-freezing locations where the air line extends through ice at the water surface.

7 Claims, 4 Drawing Figures

APPARATUS FOR AERATING AND MAINTAINING AN ICE FREE SURFACE AREA ON A BODY OF WATER

BACKGROUND OF THE INVENTION

This invention relates generally to apparatus for aerating and maintaining an ice free surface area in a body of water. More specifically, it relates to apparatus for aerating and maintaining an ice free surface area in a pond or lake.

It is well known to those skilled in this particular field that fish require oxygen to live. Conservation authorities have determined that most fish can stay alive in as little as three parts of air per million parts of water. This is the absolute minimum merely to keep them alive. To keep them healthy and growing, higher levels of oxygen are necessary.

Nature provides oxygen in two ways, absorption from the air, and from underwater plant life. In the summer, when the surface of a pond or lake is open to the air, wind and wave action stirs the surface causing air to be absorbed and distributed below the surface. Plants living under water give off oxygen through photosynthesis, using energy from the sun.

Large bodies of water such as the oceans, seas, large natural lakes and rivers generally maintain adequate oxygen content for survival and growth of fish. However, in relatively smaller bodies of water such as artificial ponds and small lakes where fish are raised for sale or recreation, there is a definite danger of oxygen depletion to the point where fish will not survive through the winter if a solid layer of ice prevents absorption of atmospheric air. The problem is worsened when snow accumulates on the ice and prevents sunlight from filtering through and keeping the oxygen-generating underwater plants alive.

The result, following the spring thaw, is hundreds or thousands of dead fish floating to the surface and washing ashore representing the loss of hundreds or thousands of dollars, and five years or more in bringing a pond or lake to peak production.

One common way of maintaining the life-supporting oxygen content of a stocked pond or lake through the winter months is to aerate it through one or more air diffusion units submerged beneath the surface and connected through an air line such as a pipe or hose to an air compressor on shore. This works fine as long as the air compressor runs continuously and keeps the air line filled with air all the way to the submerged air diffusion unit. However, air compressors are among the least efficient users of energy, and it is costly to run them all the time unnecessarily, especially at the beginning and end of the icing season when adequate aeration can be maintained running them only part time. It is customary, therefore, to turn them on and off manually, or by pre-set automatic timers, during those parts of the year when less than 24-hour-per-day operation is needed.

This poses a serious problem. In conventional pond aerating systems, prior to the present invention, water backed up all the way to the surface of the pond at the point where the air line entered the water, when the compressor was shut off. Due to the peculiar density/-temperature properties of water, higher density, warmer water remains liquid just a few feet below the surface, while the lower density, colder water rises to the surface and forms ice. If the water in the air line is allowed to flow back into the ice area, for any length of time, it, too, will freeze, blocking any further flow of air. At this time, the system is out of operation, unless the plug of ice can be found and removed from the air line.

Such ice blockage of the air line can occur even when the compressor is set for full 24 hour, continuous operation, as for example when the power fails. As a matter of actual fact, such power failures are far more common in remote or rural areas where fish ponds are maintained, than in heavily populated urban areas. This situation is accordingly in need of improvement.

SUMMARY OF THE INVENTION

Therefore, a principal object of the present invention is to provide apparatus for aerating and maintaining a surface area ice free in a pond or lake, which will prevent water from flowing backward from a submerged air diffusion unit and create an ice plug to block the air line when the compressor is turned off in freezing weather.

A specific object is to provide check valve means in a portion of the air line leading to the air diffusion unit, where the check valve means is located in a permanently-unfrozen depth of the water, thereby preventing back flow of water into the surface area where it would freeze and block the line.

A specific object is to provide the air diffusion unit in the form of a vertical pipe with an air line connected to the bottom end to release air bubbles from the top end in a series of relatively large volume, intermittent, discharges or surges to increase convection currents.

Another object is to provide check valve means mounted immediately inside or outside the pipe, where the air line connects to it, to prevent back flow of water into the air line and thereby prevent freezing in the air line where it passes through the ice layer at the surface of the body of water.

Another object is to provide, in combination, automatic timer means which will turn the air compressor on and off at predetermined intervals, and check valve means at the air diffusion unit which prevents back flow of water into a freezing zone in the air line when the compressor is turned off by the timer means.

Further objects of the invention will appear as the description proceeds.

To accomplish the above and related objects, this invention may be embodied in a form illustrated in the accompanying drawings, attention being called to the fact, however, that the drawings are illustrative only, and somewhat schematic, and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic, elevational cross-sectional view of the present invention installed in a pond, lake, reservoir or the like;

Like parts are referred to by like reference numerals throughout the figures.

DETAILED DESCRIPTION OF THE PREFERRED EMBODIMENTS

Figure 1:
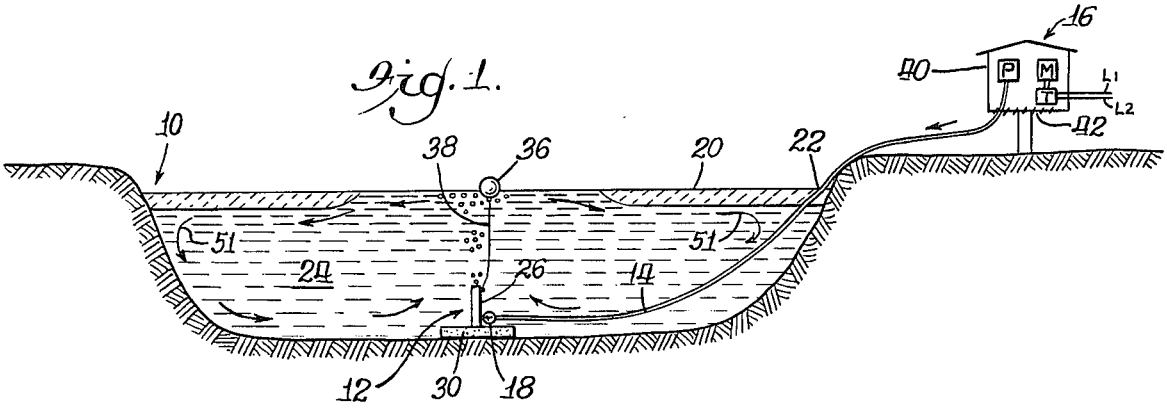

Referring now to the drawing in greater detail, the reference numeral 10 represents a body of water such as a pond, lake, or reservoir which may be stocked with fish for sale or recreation. The apparatus illustrating the present invention comprises an air diffusion unit 12 connected by air line conduit means consisting of a pipe or hose 14 to an air pressure source 16.

Figure 2:
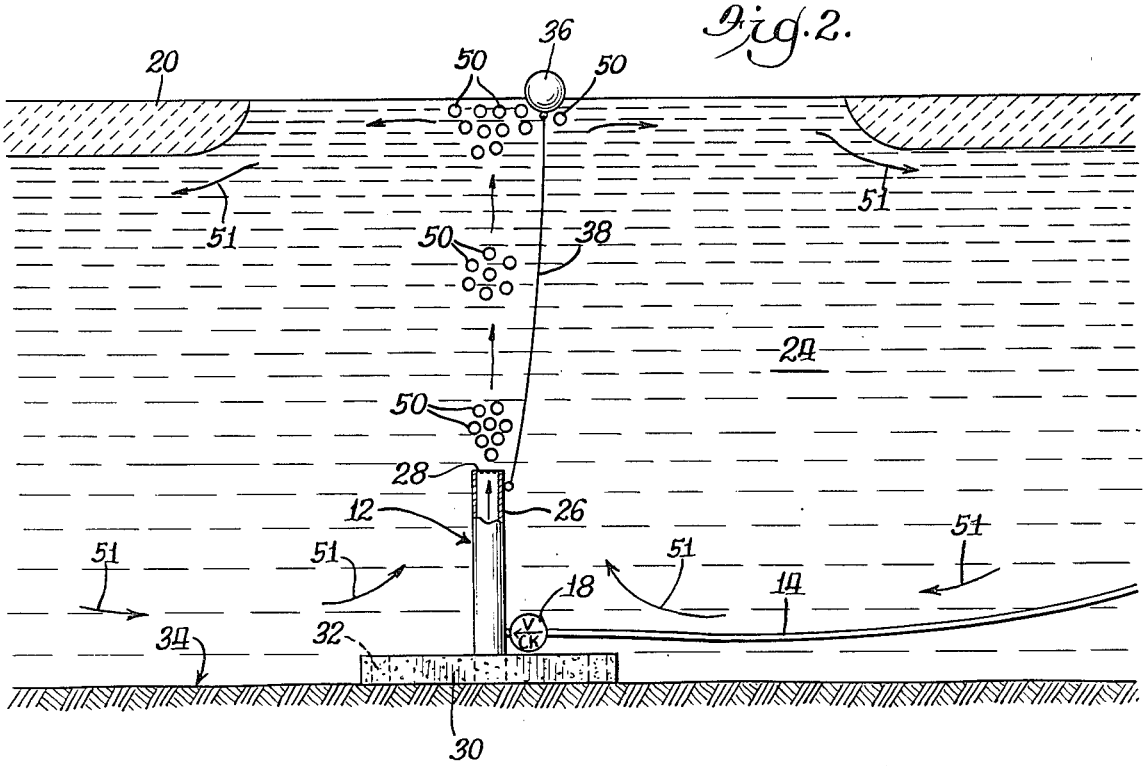
FIG. 2 is an enlarged fragmentary view of FIG. 1.

A check valve 18, of any suitable kind, is shown in FIGS. 1 and 2 connected in the air line 14 immediately adjacent the diffusion unit 12. An important thing to observe in FIG. 1 is that the air line 14 extends through the surface ice layer 20, at the location indicated by the reference numeral 22. Even in the coldest parts of the winter, water will remain permanently unfrozen, a short distance beneath the surface, as indicated by the reference numeral 24.

The air diffusion unit 12 is illustrated as a vertical pipe 26 with a screen 28 at the top end, and permanently embedded in a weighted concrete base 30. As one specific example, the pipe 26 may be a standard 4" pipe and the air line may be standard $\frac{3}{4}$" pipe or hose. The base has a series of vertical openings 32 which may be provided to reduce weight and to ease lowering it into place on the bottom 34.

An important feature of this invention is that the air line 14 discharges into the bottom of the submerged vertical pipe 26. This causes air to collect until it substantially fills the pipe at which time the air is displaced by a rapid inrush of water, causing a sudden, relatively large volume release of bubbles 50 followed by a period in which more air collects in the pipe and is released. This action repeats over and over, causing large, intermittent volumes of air to be released in surges, as indicated by the plurality of groups of large air bubbles 50 shown in FIGS. 1 and 2. This creates powerful, convection currents indicated by the arrows 51 and is a great improvement over prior air diffusion or dispersion units which release continuous, relatively fine streams of air into the water. As a result, the strong convection currents produced by the large diameter pipe 26 provide large ice-free areas and aerate much larger volumes of water then heretofore.

A marker buoy 36 may be tethered by a line 38 to the vertical pipe 26 as shown.

Figure 3:
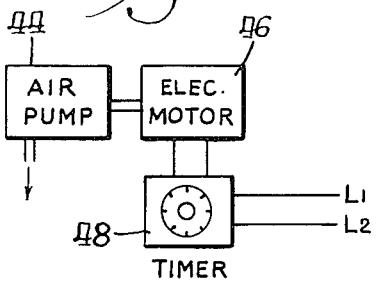
FIG. 3 is an enlarged view of the air compressor and timer means shown in FIG. 1.

Any suitable air compressor source may be used. The source 16 comprises a small, weather proof housing 40 with a floor 42 consisting of an air intake screen or louvers. As shown enlarged in FIG. 3, it contains an air pump or compressor 44 driven by an electric motor 46, controlled by a timer 48. Electric power lines $L_1$ and $L_2$ provide power for the timer and the electric motor in a conventional fashion. The compressor, motor, and timer may be standard units, suitably sized for the requirements, so will not be described herein in detail.

Figure 4:
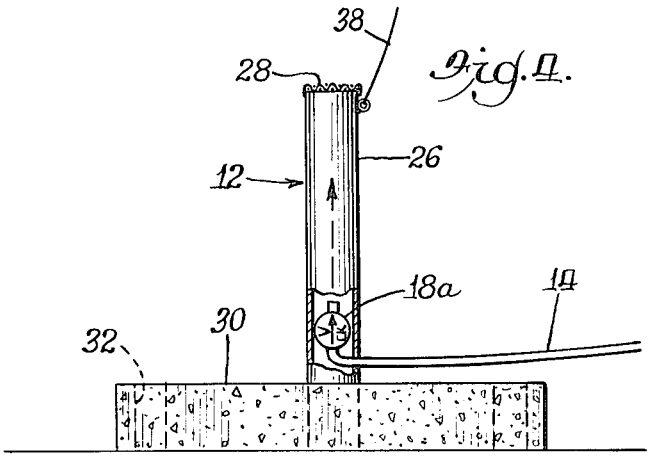
FIG. 4 is a view similar to a portion of FIG. 2, showing an alternative location for the check valve means.

The check valve 18 may be connected in the air line 14, just outside the pipe 26, as shown in FIGS. 1 and 2. Alternatively, a similar check valve **18*a* may be positioned inside the vertical pipe 26 as shown in FIG. 4. Either will function suitably. The inside location shown in FIG. 4 provides maximum protection for the check valve, but the outside location shown in FIGS. 1 and 2** provides somewhat better access for repair and replacement.

The timer 48 may be adjusted to turn the air compressor on for a certain period of time followed by turning it off for a certain period of time, all determined by the operator in accordance with the on/off cycle which he determines best.

It is in connection with such timed on/off operation that the check valve 18 is advantageous. If it were not for the check valve, when the air compressor is shut off, water would flow back through the air line 14 to the location 22, where the cold, top temperature creates the ice layer 20. This would quickly freeze the water in the air line into a plug of ice at the location 22 and, further operation of the air compressor would be useless. However, with the check valve 18 (or **18*a*, in FIG. 4), back flow of water is prevented and the entire line 14 is filled with air for its entire length including the crucial location 22, thereby preventing the formation of such an ice plug. Then, whenever the air compressor 44 is subsequently turned on, whether it be minutes, hours, or days after it was turned off, the air immediately begins to flow into the vertical pipe 26, collect in it, and release periodically through screen 28 in groups of large bubbles 50, 50 as described. This upward flow creates heavy convection currents in the direction of arrows 51**, stirring the entire body of water. Thus, aerated water is distributed to far reaches of the pond or lake substantially distant from the diffusion unit.

While certain novel features of this invention have been shown and described and are pointed out in the annexed claims, it will be understood that various omissions, substitutions and changes in the forms and details of the device illustrated and its operation can be made by those skilled in the art without departing from the spirit of the invention. For example, while the check valves 18 and **18*a* are shown in their preferred locations immediately adjacent or within the pipe 26, such check valve means could function suitably at any location where the body of unfrozen water 24** exists. From a practical stand point, for manufacture and maintenance, it is better located where shown in the drawings.

The embodiments of the invention in which an exclusive property or privilege is claimed are defined as follows:

1. Apparatus for aerating and maintaining a surface area ice free in a body of water such as a pond or lake comprising:

an air diffusion unit comprising an imperforate vertical pipe with a closed bottom end and an open upper end anchored below the surface of said body of water;

an air line extending from a source of air under pressure to the interior of the pipe at the closed bottom end thereof;

the pipe having a large transverse cross-section relative to the cross-section of the air line enabling continual, discrete, large-volume air discharges through repetition of a cycle in which air collects in the bottom of the pipe until it is displaced by a rapid inrush of water into the top end expelling air in a sudden large volume release followed by a period of no discharge while air collects in the pipe for the next discharge; and check valve means in a portion of said air line in water which is sufficiently deep to remain permanently unfrozen at the bottom of said body of water, said check valve means thereby maintaining said air line ice free by preventing the back flow of water from said air diffusion unit to below-freezing locations near or above the surface level.

2. The combination as set forth in claim 1 wherein said check valve means is located immediately adjacent said air diffusion unit.

3. The combination as set forth in claim 1 wherein said check valve means is located within said air diffusion unit.

4. The combination as set forth in claim 1 wherein said air diffusion unit is a vertical pipe and said air line directs air into the bottom of said vertical pipe causing air bubbles to release from the top of the vertical pipe into the water in a series of relatively large volume intermittent discharges to create powerful convection water currents in said body of water.

5. The combination as set forth in claim 4 wherein a screen is provided at the top of the vertical pipe to keep foreign material from accumulating inside the pipe.

6. The combination of claim 1 wherein said source of air under pressure is an air compressor located on shore adjacent said body of water.

7. The combination of claim 6 wherein adjustable timer means controls on and off cycles of said air compressor enabling operation thereof to be regulated in accordance with need.

* * * * *